US007278892B1

(12) United States Patent
Chien et al.

(10) Patent No.: US 7,278,892 B1
(45) Date of Patent: Oct. 9, 2007

(54) CONNECTOR FOR A BATTERY

(75) Inventors: Min-Lung Chien, Hsin-Tien (TW); Hsueh-Chih Cheng, Hsin-Tien (TW); Hong-Wei Zheng, Guangdong (CN); Hong-Zhe Yan, Guangdong (CN)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 11/676,061

(22) Filed: Feb. 16, 2007

(30) Foreign Application Priority Data

Jun. 2, 2006 (TW) ..... 95209608 U

(51) Int. Cl.
*H01R 4/48* (2006.01)

(52) U.S. Cl. ..... 439/862

(58) Field of Classification Search ..... 439/862, 439/100, 96, 500, 628, 65, 733.1
See application file for complete search history.

(56) References Cited

U.S. PATENT DOCUMENTS 6,302,727 B1 * 10/2001 Fedorjaka ..... 439/500
6,398,598 B2 * 6/2002 Masumoto ..... 439/862
6,409,529 B1 * 6/2002 Liu et al. ..... 439/188
6,447,338 B1 * 9/2002 Bricaud et al. ..... 439/630
6,454,607 B2 * 9/2002 Bricaud ..... 439/630
6,616,485 B2 * 9/2003 Harasawa et al. ..... 439/630
D486,448 S * 2/2004 Watanabe et al. ..... D13/120
6,843,688 B2 * 1/2005 Matsunaga et al. ..... 439/630
6,875,049 B2 * 4/2005 Kyowski et al. ..... 439/500
6,951,488 B2 * 10/2005 Hsieh ..... 439/660
6,994,566 B2 * 2/2006 You ..... 439/66
7,153,173 B2 * 12/2006 Harasawa et al. ..... 439/862

* cited by examiner

*Primary Examiner*—Neil Abrams
*Assistant Examiner*—Harshad C Patel
(74) *Attorney, Agent, or Firm*—James H. Walters

(57) ABSTRACT

A connector for a battery has an insulative housing and a plurality of terminals. The insulative housing has a plurality of cavities and each cavity has a front opening and two inner sidewalls. Each inner sidewall has a rear mounting slot and a front mounting slot. The terminals correspond respectively to and are mounted respectively in the cavities and each terminal has an arm portion, a body portion and a soldering portion. The arm portion is resilient. The body portion is mounted in a corresponding cavity, is formed on the arm portion and having two wing portions mounted respectively in the rear mounting slots. The soldering portion is formed on the body portion and has two hook portions mounted respectively in the front mounting slots in the corresponding cavity. The terminal is mounted stably and securely in the corresponding cavity.

7 Claims, 2 Drawing Sheets

CONNECTOR FOR A BATTERY

BACKGROUND OF THE INVENTION

1. Field of the Invention

The present invention relates to a connector, and more particularly to a connector for a battery and having an insulative housing and a plurality of terminals mounted stably in the insulative housing without separating from the insulative housing.

2. Description of Related Art

The electronic devices such as cellular phones and music players become smaller and lighter so that electronic components inside the electronic devices have to be sized smaller and arranged compactly. Therefore, a compact, safety and reliable connector for a battery is important and necessary for the electronic devices.

A conventional connector for a battery and has an insulative housing and a plurality of terminals. Each terminal is mounted on a single mounting point on the insulative housing due to the conventional connector cost down. The engagement of the terminal and the insulative housing on the single mounting point is insufficient and weak so that the terminal easily sways and even separates from the insulative housing after a battery is repetitively engages with and presses against terminal. Furthermore, the terminal is not stable and easily vibrates to be disengaged from a contact on the battery so that the electricity transmission between the connector and the battery breaks off.

To overcome the shortcomings, the present invention provides a connector for a battery to mitigate or obviate the aforementioned problems.

SUMMARY OF THE INVENTION

The main objective of the invention is to provide a connector for a battery that has an insulative housing and a plurality of terminals mounted stably in the insulative housing without separating from the insulative housing.

A connector for a battery in accordance with the present invention comprises an insulative housing and a plurality of terminals.

The insulative housing has a plurality of cavities and each cavity has a front opening and two inner sidewalls. Each inner sidewall has a rear mounting slot and a front mounting slot. The terminals correspond respectively to and are mounted respectively in the cavities and each terminal has an arm portion, a body portion and a soldering portion. The arm portion is resilient. The body portion is mounted in a corresponding cavity, is formed on the arm portion and having two wing portions mounted respectively in the rear mounting slots. The soldering portion is formed on the body portion and has two hook portions mounted respectively in the front mounting slots in the corresponding cavity.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
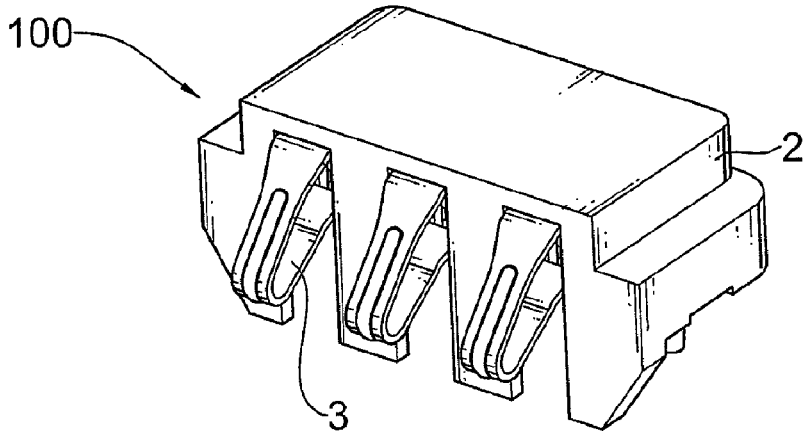
FIG. 1 is a perspective view of a connector for a battery in accordance with the present invention.
Figure 2:
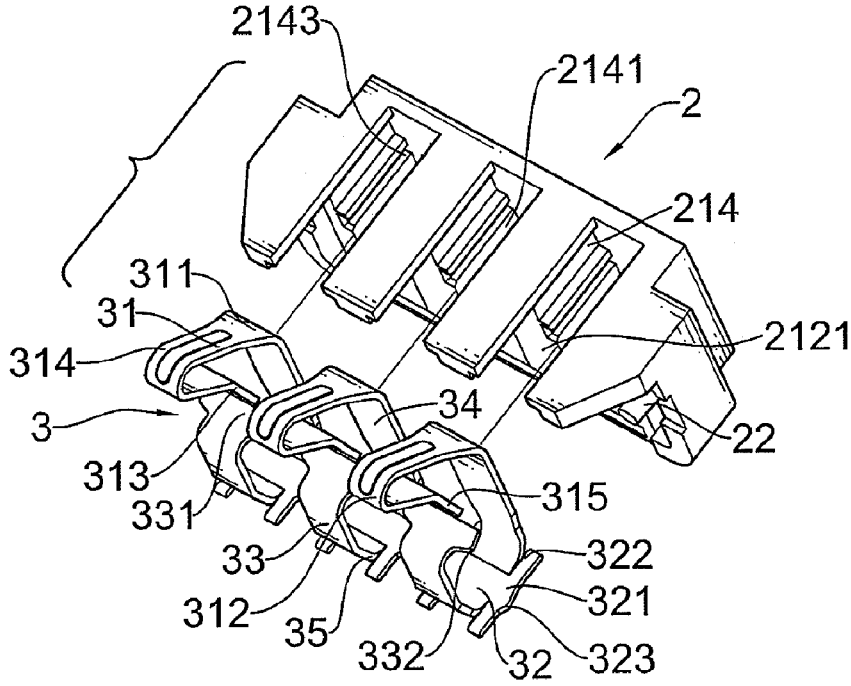
FIG. 2 is an exploded perspective view of the connector in FIG. 1.
Figure 3:
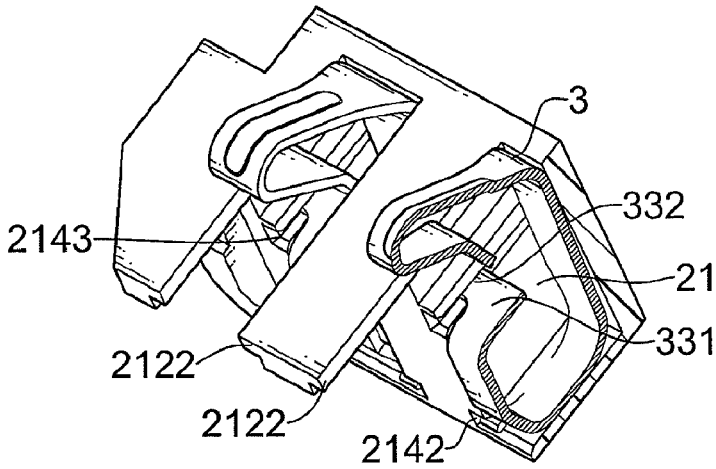
FIG. 3 is a cross sectional perspective view of the connector in FIG. 1.
Figure 4:
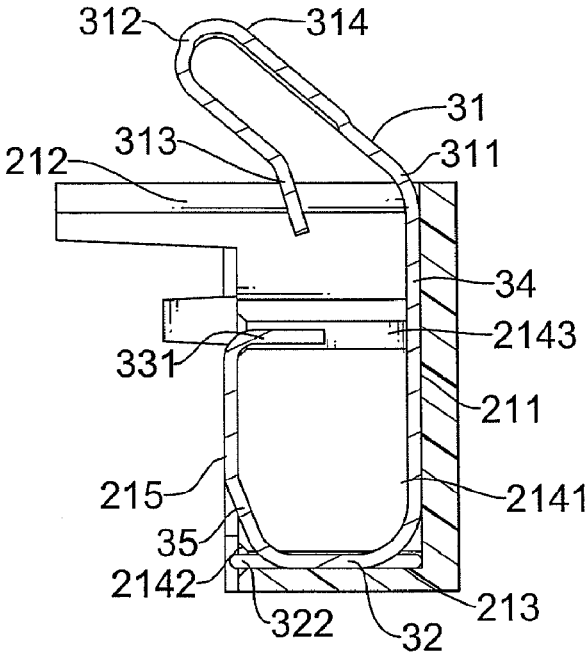
FIG. 4 is a cross sectional side view of the connector in FIG. 3.

With reference to FIGS. 1 to 4, a connector 100 is mounted in a printed circuit board (PCB) in an electronic device such as a cellular phone or a music player and may be engaged with a connector on a battery to provide an electricity connection to the electronic device.

The connector 100 has an insulative housing 2 and a plurality of terminals 3.

The insulative housing 2 has a top portion 211, a bottom portion, a front portion 212, a rear portion 213, a plurality of cavities 21 and a plurality of mounting posts 22.

The cavities 21 are defined in the front portion 212 and the bottom portion, are arranged in a row and each cavity 21 has a front opening 2121, a bottom opening 215 and two inner sidewalls 214. The front opening 2121 is defined through the front portion 212 and has two side edges and two blocking strips 2122 formed respectively on and protruding respectively inward from the side edges and facing each other. The bottom opening 215 is defined through the bottom portion. Each inner sidewall 214 has a protrusion 2141 formed on and protruding from the inner sidewalls 214 and having a rear mounting slot 2142 and a front mounting slot 2143. The rear mounting slot 2142 is defined in the protrusion 2141 adjacent to the rear portion 213 and is communicated with the bottom opening 215. The front mounting slot 2143 is defined in the protrusion 2141 adjacent to the front opening 2121 and is communicated with the bottom opening 215.

The mounting posts 22 are formed on the bottom portion and may be mounted through the PCB.

The terminals 3 correspond respectively to and are mounted respectively in the cavities 21 in the insulative housing 2 and each terminal 3 has an arm portion 31, a body portion 32 and a soldering portion 33.

The arm portion 31 is U-shaped, is resilient, is exposed out of the front opening 2121 of a corresponding cavity 21 and has a front end, a rear end, a curved portion 311, a U-turn portion 312, a distal portion 313, two blocking tabs 315 and a contacting portion 314. The curved portion 311 is formed on the rear end of the arm portion 31. The U-turn portion 312 is formed on the front end, turns backward and faces the front opening 2121. The distal portion 313 is T-shaped, is inclined, is formed on the U-turn portion 312, extends in the corresponding cavity 21 through the front opening 2121 and has two opposite sides. The blocking tabs 315 are formed respectively on the sides of the distal portion 313 and are blocked respectively by the blocking strips 2122 of the front opening 2121 of the corresponding cavity 21 to prevent the distal portion 313 from moving out of the corresponding cavity 21 through the front opening 2121. The contacting portion 314 is formed longitudinally on and protrudes from the arm portion 31 and may contact a contact on the connector of the battery.

The body portion 32 is mounted in the corresponding cavity 21, is formed on and protrudes backward from the curved portion 311 on the arm portion 31 and abuts the rear portion 213 of the insulative housing 2. The body portion 32 has two opposite sides, a top end, a bottom end, a longitudinal portion 34 and two wing portions 321. The longitudinal portion 34 is formed on the top end of the body portion 32, is connected to the curved portion 311 and abuts the top portion 211 of the insulative housing 2. The wing portions 321 are formed respectively on and protrude respectively outward from the sides of the body portion 32 and correspond respectively to and are mounted respectively in the rear mounting slots 2142 in the corresponding cavity 21. Each wing portion 321 has two opposite ends, two holding portions 322 and a protruding tab 323. The holding portions 322 are formed respectively on and protrude respectively from the ends of the wing 321 and are mounted in a corresponding rear mounting slot 2142 in the corresponding cavity 21. The protruding tab 323 is pointy, is formed on the wing portion 321 and presses against an inner surface of the rear mounting slot 2142 to prevent the wing 321 from sliding inadvertently in the rear mounting slot 2142.

The soldering portion 33 is formed on and protrudes forward from bottom end of the body portion 32 and has a front end, a rear end, an inclined portion 35 and a tail portion 331. The inclined portion 35 is formed on and protrudes forward from the rear end of the soldering portion 33 and is connected to the bottom end of the body portion 32. The tail portion 331 is formed on and protrudes perpendicularly from the front end of the soldering portion 33 and has two opposite sides and two hook portions 332. The hook portions 332 are formed respectively on and protrude respectively outward from the sides of the tail portion 331 and are mounted respectively in the front mounting slots 2143 in the corresponding cavity 21.

When the connector 100 on the PCB is engaged with the connector on the battery, the arm portions 31 of the terminals 3 are pressed respectively against the contacts on the battery and are retracted respectively in the cavities 21. When the battery is disengaged from the connector 100 on the PCB, the arm portions 31 extends respectively out of the cavities 21 and the blocking strips 2122 in cavities 21 block the blocking tabs 315 on the arm portions 31.

Each terminal 3 is mounted securely in a corresponding cavity 21 through two mounting points. One mounting point is where the wind portions 321 on the body portion 32 are mounted respectively in the rear mounting slots 2142. The other mounting point is where the hook portions 332 on the soldering portion 33 are mounted respectively in the front mounting slots 2143. With the mounting points, the terminal 3 is mounted stably and securely in the corresponding cavity 21 and would not sway or vibrate inadvertently. Therefore, connector 3 may provide a fine electricity transmission when engaged with the battery.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector for a battery, the connector comprising:

an insulative housing having a plurality of cavities defined in the insulative housing, each cavity having two inner sidewalls, a front opening, a bottom opening, two rear mounting slots defined respectively in the inner sidewalls and two front mounting slots defined respectively in the inner sidewalls; and a plurality of the terminals, the terminals corresponding respectively to and mounted respectively in the cavities and each terminal having an arm portion being resilient and exposed out of the front opening of a corresponding cavity;

a body portion mounted in the corresponding cavity, formed on and protruding from the arm portion and having two opposite sides and two wing portions formed respectively on and protruding respectively outward from the sides of the body portion, corresponding respectively to the rear mounting slots in the corresponding cavity and each wing portion having two opposites ends and two holding portions formed respectively on and protruding respectively from the ends and mounted in a corresponding rear mounting slot; and a soldering portion formed on and protruding from the body portion and having a tail portion formed on and protruding from soldering portion and having two opposites sides and two hook portions formed respectively on and protruding respectively outward from the sides of the tail portion and mounted respectively in the front mounting slots in the corresponding cavity.

2. The connector as claimed in claim 1, wherein:

the insulative housing further has a top portion, a bottom portion, a front portion and a rear potion;

the front opening of each cavity is defined through the front portion and the rear opening of each cavity is defined through the rear portion; and the rear mounting slot of each cavity is adjacent to the rear portion and is communicated with the bottom opening of the cavity, and the front mounting slot of each cavity is adjacent to the front opening and is communicated with the bottom opening of the cavity.

3. The connector as claimed in claim 2, wherein each inner sidewall of each cavity further has a protrusion formed on and protruding from the inner sidewall and in which the rear and front mounting slots of the inner sidewall are defined.

4. The connector as claimed in claim 3, wherein each wing on the body portion of each terminal further has a protruding tab being pointy, formed on the wing portion and pressing against an inner surface of the corresponding rear mounting slot.

5. The connector as claimed in claim 4, wherein:

the arm portion of each terminal is U-shaped and has a front end, a rear end, a curved portion formed on rear end, a U-turn portion formed on the front end, turning backward and facing the front opening of the corresponding cavity and a distal portion being T-shaped and inclined, formed on the U-turn portion, extending in the corresponding cavity through the front opening and having two opposite sides;

the body portion of each terminal protrudes backward from the curved portion on the arm portion of the terminal, abuts the rear portion of the insulative housing and further has a top end, a bottom end and a longitudinal portion formed on the top end of the body portion, connected to the curved portion and abutting the top portion of the insulative housing; and the soldering portion of each terminal protrudes forward from the bottom end of the body portion of the terminal and further has a front end, a rear end and an inclined portion formed on and protruding forward from the rear end of the soldering portion and connected to the bottom end of the body portion.

6. The connector as claimed in claim 5, wherein:

the front opening of each cavity further has two side edges and two blocking strips formed respectively on and protruding respectively inward from the side edges and facing each other; and the arm portion of each terminal further has two blocking tabs formed respectively on the sides of the distal portion and blocked respectively by the blocking strips of the front opening of the corresponding cavity.

7. The connector as claimed in claim 6, wherein the arm portion of each terminal further has a contacting portion formed longitudinally on and protruding from the arm portion.

* * * * *